US009691341B2

(12) United States Patent
Ahn et al.

(10) Patent No.: US 9,691,341 B2
(45) Date of Patent: Jun. 27, 2017

(54) DATA DRIVER AND DISPLAY APPARATUS INCLUDING THE SAME

(71) Applicant: SAMSUNG DISPLAY CO., LTD., Yongin, Gyeonggi-Do (KR)

(72) Inventors: Ik-Hyun Ahn, Hwaseong-si (KR); Yoon-Gu Kim, Seoul (KR); Bong-Im Park, Asan-si (KR)

(73) Assignee: SAMSUNG DISPLAY CO., LTD., Yongin, Gyeonggi-Do (KR)

( * ) Notice: Subject to any disclaimer, the term of this patent is extended or adjusted under 35 U.S.C. 154(b) by 13 days.

(21) Appl. No.: 14/698,979

(22) Filed: Apr. 29, 2015

(65) Prior Publication Data

US 2016/0093258 A1 Mar. 31, 2016

(30) Foreign Application Priority Data

Sep. 29, 2014 (KR) ..... 10-2014-0130535

(51) Int. Cl.
*G09G 3/36* (2006.01)

(52) U.S. Cl.
CPC ..... *G09G 3/3614* (2013.01); *G09G 3/3688* (2013.01); *G09G 2310/027* (2013.01); *G09G 2310/0286* (2013.01); *G09G 2310/0291* (2013.01); *G09G 2310/08* (2013.01); *G09G 2320/0276* (2013.01)

(58) Field of Classification Search
CPC ..... G09G 3/3614; G09G 3/3688; G09G 2310/0286; G09G 2320/0276; G09G 2310/027; G09G 2310/08; G09G 2310/0291
See application file for complete search history.

(56) References Cited

U.S. PATENT DOCUMENTS 8,269,706 B2 * 9/2012 Hwang ..... G09G 3/3614 345/208
2012/0146967 A1 * 6/2012 Kim ..... G09G 3/3688 345/204
2015/0022512 A1 1/2015 Ahn et al.

FOREIGN PATENT DOCUMENTS

KR 1020080097530 11/2008
KR 1020090040764 4/2009
KR 1020120134238 12/2012

* cited by examiner

*Primary Examiner* — Charles Hicks
(74) *Attorney, Agent, or Firm* — F. Chau & Associates, LLC

(57) ABSTRACT

A data driver includes a digital-to-analog converter, a control signal output circuit, and an output buffer. The digital-to-analog converter generates first data voltages and second data voltages based on image data and a polarity control signal. Each first data voltage has a positive polarity, and each second data voltage has a negative polarity. The control signal output circuit outputs a first output control signal and a second output control signal based on the polarity control signal. A phase of the second output control signal is different from a phase of the first output control signal. The output buffer outputs the first data voltages based on the first output control signal and outputs the second data voltages based on the second output control signal.

23 Claims, 12 Drawing Sheets

FIG. 4B

| | | | | | | | | |
|---|---|---|---|---|---|---|---|---|
| PR1 | + | + | − | − | + | + | − | − |
| PR2 | − | − | + | + | − | − | + | + |
| PR3 | + | + | − | − | + | + | − | − |
| PR4 | − | − | + | + | − | − | + | + |

DATA DRIVER AND DISPLAY APPARATUS INCLUDING THE SAME

CROSS-REFERENCE TO RELATED APPLICATION

This application claims priority under 35 U.S.C. §119 to Korean Patent Application No. 10-2014-0130535, filed on Sep. 29, 2014, in the Korean Intellectual Property Office (KIPO), the disclosure of which is incorporated by reference herein in its entirety.

TECHNICAL FIELD

Exemplary embodiments of the present inventive concept relate to a display apparatus, and more particularly to, a data driver and a display apparatus including the data driver.

DISCUSSION OF THE RELATED ART

Generally, a liquid crystal display (LCD) apparatus includes a first substrate including a pixel electrode, a second substrate including a common electrode, and a liquid crystal layer disposed between the first and second substrates. An electric field is generated by voltages applied to the pixel electrode and the common electrode. Transmittance of light passing through the liquid crystal layer may be controlled by adjusting the electric field formed therein, and thus, a desired image may be displayed.

To prevent the LCD apparatus from being degraded, a polarity of a data voltage applied to a pixel of the LCD apparatus is reversed periodically. However, as a size of the LCD apparatus increases, waveforms of the data voltage and/or a gate signal applied to a pixel may vary depending on the position of the pixel in the LCD apparatus.

SUMMARY

According to an exemplary embodiment of the present inventive concept, a data driver is provided. The data driver includes a shift register, a data latch, a digital-to-analog converter, a control signal output circuit, and an output buffer. The shift register generates latch control signals based on a horizontal start signal and a data clock signal. The data latch stores parallel image data based on the latch control signals and outputs the parallel image data based on a data load signal. The digital-to-analog converter generates first data voltages and second data voltages based on the parallel image data and a polarity control signal. Each of the first data voltages has a positive polarity, and each of the second data voltages has a negative polarity. The control signal output circuit outputs a first output control signal and a second output control signal based on the polarity control signal. A phase of the second output control signal is different from a phase of the first output control signal. The output buffer outputs the first data voltages based on the first output control signal and outputs the second data voltages based on the second output control signal.

The output buffer may output the first data voltages in synchronization with the first output control signal and may output the second data voltages in synchronization with the second output control signal. The phase of the first output control signal may lead the phase of the second output control signal by a first period, and phases of the first data voltages may lead phases of the second data voltages by the first period.

A period to charge pixels based on the first data voltages may increase by the first period.

The control signal output circuit may include a first selector and a second selector. The first selector may select one of the first output control signal or the second output control signal based on the polarity control signal. The second selector may select another one of the first output control signal or the second output control signal based on the polarity control signal.

The output buffer may be connected to a plurality of data lines. The first selector may be connected to first data lines among the plurality of data lines, and the second selector may be connected to second data lines among the plurality of data lines.

During a first horizontal period, the output buffer may output one of the first data voltages or the second data voltages through the first data lines based on one of the first output control signal or the second output control signal, and may output another one of the first data voltages or the second data voltages through the second data lines based on another one of the first output control signal or the second output control signal.

The data driver may further include a data receiver. The data receiver may receive serial image data and may convert the serial image data into the parallel image data.

The data driver may further include a gamma compensator. The gamma compensator may generate gamma compensation data. The digital-to-analog converter may compensate the parallel image data based on the gamma compensation data to generate the first data voltages or the second data voltages.

According to an exemplary embodiment of the present inventive concept, a display apparatus is provided. The display apparatus includes a display panel, a gate driver, a data driver, and a timing controller. The display panel is connected to a plurality of gate lines and a plurality of data lines. The gate driver generates a plurality of gate signals and applies the plurality of gate signals to the plurality of gate lines. The data driver generates a plurality of data voltages based on output image data and applies the plurality of data voltages to the plurality of data lines. The timing controller controls operations of the gate driver and the data driver and generates the output image data based on input image data. The data driver includes a shift register, a data latch, a digital-to-analog converter, a control signal output circuit, and an output buffer. The shift register generates latch control signals based on a horizontal start signal and a data clock signal. The data latch stores parallel image data corresponding to the output image data based on the latch control signals and outputs the parallel image data based on a data load signal. The digital-to-analog converter generates at least one of first data voltages or second data voltages based on the parallel image data and a polarity control signal. Each of the first data voltages has a positive polarity, and each of the second data voltages has a negative polarity. The control signal output circuit outputs at least one of a first output control signal or a second output control signal based on the polarity control signal. A phase of the second output control signal is different from a phase of the first output control signal. The output buffer outputs the first data voltages based on the first output control signal and outputs the second data voltages based on the second output control signal.

The output buffer may output the first data voltages in synchronization with the first output control signal and may output the second data voltages in synchronization with the second output control signal. The phase of the first output control signal may lead the phase of the second output control signal by a first period, and phases of the first data voltages may lead phases of the second data voltages by the first period.

A period to charge pixels in the display panel based on the first data voltages may increase by the first period.

During a first horizontal period, the output buffer may output one of the first data voltages or the second data voltages through first data lines among the plurality of data lines based on one of the first output control signal or the second output control signal, and may output another one of the first data voltages or the second data voltages through second data lines among the plurality of data lines based on another one of the first output control signal or the second output control signal.

The control signal output circuit may include a first selector and a second selector. The first selector may be connected to the first data lines and may select one of the first output control signal or the second output control signal based on the polarity control signal. The second selector may be connected to the second data lines and may select another one of the first output control signal or the second output control signal based on the polarity control signal.

The output buffer may output one of the first data voltages or the second data voltages through the plurality of data lines based on one of the first output control signal or the second output control signal during a first horizontal period, and may output another one of the first data voltages or the second data voltages through the plurality of data lines based on another one of the first output control signal or the second output control signal during a second horizontal period subsequent to the first horizontal period.

The control signal output circuit may include a first selector. The first selector may be connected to the plurality of data lines and may select one of the first output control signal or the second output control signal based on the polarity control signal.

When the output buffer outputs the first data voltages during the first horizontal period, the gate driver may generate a first gate signal among the plurality of gate signals based on a first gate clock signal, and a plurality of first pixels connected to a first gate line among the plurality of gate lines may be charged based on the first gate signal and the first data voltages. When the output buffer outputs the second data voltages during the second horizontal period, the gate driver may generate a second gate signal among the plurality of gate signals based on a second gate clock signal, and a plurality of second pixels connected to a second gate line among the plurality of gate lines may be charged based on the second gate signal and the second data voltages. A phase of the second gate clock signal may be different from a phase of the first gate clock signal.

The first data voltages may be applied to the plurality of first pixels in synchronization with the first gate signal, and the second data voltages may be applied to the plurality of second pixels in synchronization with the second gate signal. The phase of the first gate clock signal may lag the phase of the second gate clock signal by a first period, and the first gate signal may be activated after the first period elapses from a time at which the first horizontal period begins.

According to an exemplary embodiment of the present inventive concept, a data driver is provided. The data driver includes a shift register, a data latch, a digital-to-analog converter, a control signal output circuit, and an output buffer. The shift register generates latch control signals based on a horizontal start signal and a data clock signal. The data latch stores parallel image data based on the latch control signals and outputs the parallel image data based on a data load signal. The digital-to-analog converter generates one of first data voltages or second data voltages based on the parallel image data and a polarity control signal. Each of the first data voltages has a positive polarity, and each of the second data voltages has a negative polarity. The control signal output circuit outputs one of a first output control signal or a second output control signal based on the polarity control signal. A phase of the second output control signal is different from a phase of the first output control signal. The output buffer outputs one of the first data voltages and the second data voltages based on one of the first output control signal or the second output control signal.

The output buffer may output the first data voltages in synchronization with the first output control signal or may output the second data voltages in synchronization with the second output control signal. The phase of the first output control signal may lead the phase of the second output control signal by a first period, and phases of the first data voltages may lead phases of the second data voltages by the first period.

The output buffer may be connected to a plurality of data lines. The output buffer may output one of the first data voltages or the second data voltages through the plurality of data lines based on one of the first output control signal or the second output control signal during a first horizontal period.

According to an exemplary embodiment of the present inventive concept, a display apparatus is provided. The display apparatus includes a display panel, a timing controller, and a gate driver. The display panel includes a first pixel and a second pixel. The timing controller generates a first gate clock signal and a second gate clock signal. The gate driver generates a first gate signal and a second gate signal applied to the first pixel and the second pixel, respectively. The first pixel and the second pixel are applied with data voltage having opposite polarities to each other. The gate driver generates the first gate signal based on the first gate clock signal and the second gate signal based on the second gate clock signal. A phase of the first gate clock signal is different from a phase of the second gate clock signal.

BRIEF DESCRIPTION OF THE DRAWINGS

Illustrative, non-limiting exemplary embodiments of the present inventive concept will be more clearly understood from the following detailed description taken in conjunction with the accompanying drawings, in which:

FIG. 4B is a diagram illustrating a display panel that operates based on a data driver including the output buffer of FIG. 4A according to an exemplary embodiment of the present inventive concept;

DETAILED DESCRIPTION OF THE EMBODIMENTS

Figure 1:
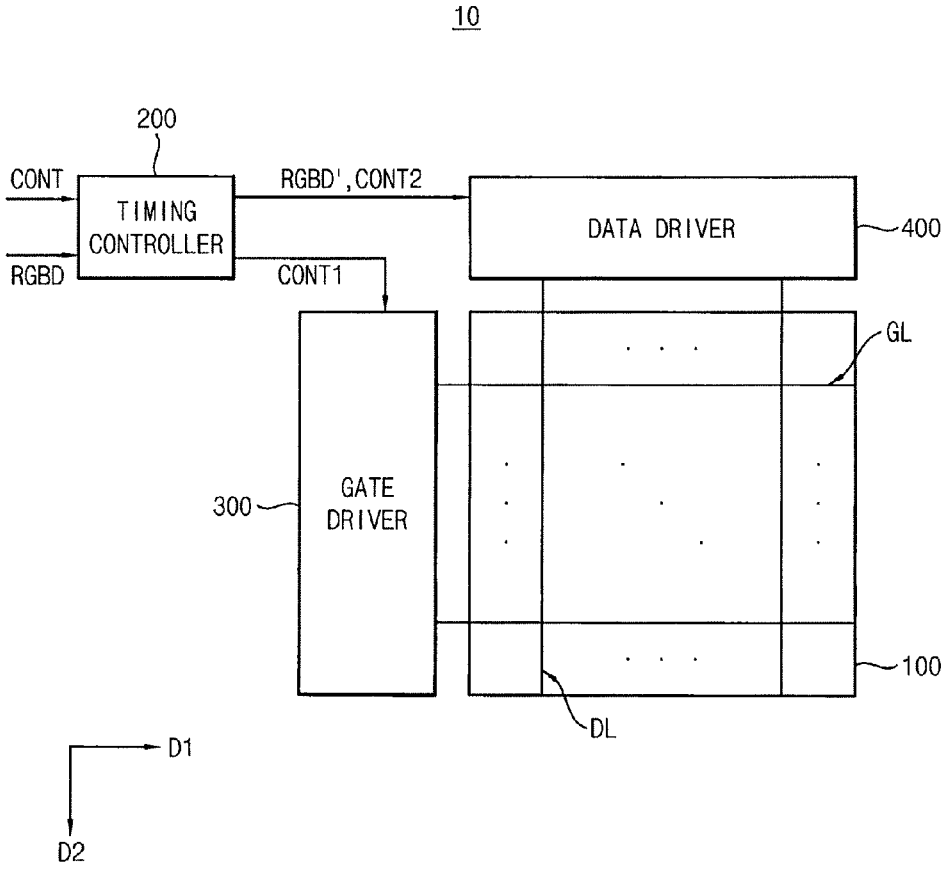
FIG. 1 is a block diagram illustrating a display apparatus according to an exemplary embodiment of the present inventive concept.

Various exemplary embodiments of the present inventive concept will be described more fully with reference to the accompanying drawings, in which exemplary embodiments thereof are shown. This present inventive concept may, however, be embodied in many different forms and should not be construed as limited to the embodiments set forth herein. Like reference numerals may refer to like elements throughout the specification and drawings.

It will be understood that, although the terms first, second, etc. may be used herein to describe various elements, these elements should not be limited by these terms. These terms are used to distinguish one element from another. For example, a first element could be termed a second element, and, similarly, a second element could be termed a first element, without departing from the scope of the present inventive concept. As used herein, the term "and/or" includes any and all combinations of one or more of the associated listed items.

As used herein, the singular forms "a," "an" and "the" are intended to include the plural forms as well, unless the context clearly indicates otherwise.

FIG. 1 is a block diagram illustrating a display apparatus according to an exemplary embodiment of the present inventive concept.

Referring to FIG. 1, a display apparatus 10 includes a display panel 100, a timing controller 200, a gate driver 300, and a data driver 400.

The display panel 100 is connected to a plurality of gate lines GL and a plurality of data lines DL. The display panel 100 displays an image having a plurality of grayscales based on image data RGBD' output from the timing controller 200. The gate lines GL may extend in a first direction D1, and the data lines DL may extend in a second direction D2 crossing (e.g., substantially perpendicular to) the first direction D1.

The display panel 100 may include a plurality of pixels that are arranged in a matrix form. Each pixel may be electrically connected to a respective one of the gate lines GL and a respective one of the data lines DL Each pixel may include a switching element, a liquid crystal capacitor, and a storage capacitor. The liquid crystal capacitor and the storage capacitor may be electrically connected to the switching element. For example, the switching element may be a thin film transistor. The liquid crystal capacitor may include a first electrode connected to a pixel electrode and a second electrode connected to a common electrode. A data voltage may be applied to the first electrode of the liquid crystal capacitor. A common voltage may be applied to the second electrode of the liquid crystal capacitor. The storage capacitor may include a first electrode connected to the pixel electrode and a second electrode connected to a storage electrode. The data voltage may be applied to the first electrode of the storage capacitor. A storage voltage may be applied to the second electrode of the storage capacitor. The storage voltage may be substantially equal to the common voltage.

Each pixel may have a rectangular shape. For example, each pixel may have a relatively short side in the first direction D1 and a relatively long side in the second direction D2. The relatively short side of each pixel may be substantially parallel to the gate lines GL. The relatively long side of each pixel may be substantially parallel to the data lines DL.

The timing controller 200 controls operations of the gate driver 300 and the data driver 400. The timing controller 200 receives input image data RGBD and an input control signal CONT from an external device (e.g., a host). The input image data RGBD may include a plurality of input pixel data for the plurality of pixels. Each input pixel data may include red grayscale data R, green grayscale data G, and blue grayscale data B for a respective one of the plurality of pixels. The input control signal CONT may include a master clock signal, a data enable signal, a vertical synchronization signal, a horizontal synchronization signal, etc.

The timing controller 200 generates the output image data RGBD', a first control signal CONT1, and a second control signal CONT2 based on the input image data RGBD and the input control signal CONT.

For example, the timing controller 200 may generate the output image data RGBD' based on the input image data RGBD. The output image data RGBD' may be provided to the data driver 400. In an exemplary embodiment of the present inventive concept, the output image data RGBD' may be image data that is substantially the same as the input image data RGBD. In an exemplary embodiment of the present inventive concept, the output image data RGBD' may be compensated image data that is generated by compensating the input image data RGBD. For example, the timing controller 200 may perform an image quality compensation, a spot compensation, an adaptive color correction (ACC), and/or a dynamic capacitance compensation (DCC) on the input image data RGBD to generate the output image data RGBD'. Similarly to the input image data RGBD, the output image data RGBD' may include a plurality of output pixel data for the plurality of pixels.

The timing controller 200 may generate the first control signal CONT1 based on the input control signal CONT. The first control signal CONT1 may be provided to the gate driver 300, and a driving timing of the gate driver 300 may be controlled based on the first control signal CONT1. The first control signal CONT1 may include a vertical start signal, a gate clock signal, etc. The timing controller 200 may generate the second control signal CONT2 based on the input control signal CONT. The second control signal CONT2 may be provided to the data driver 400, and a driving timing of the data driver 400 may be controlled based on the second control signal CONT2. The second control signal CONT2 may include a horizontal start signal, a data clock signal, a data load signal, a polarity control signal, an output control signal, etc.

The gate driver 300 receives the first control signal CONT1 from the timing controller 200. The gate driver 300 generates a plurality of gate signals for driving the gate lines GL based on the first control signal CONT1. The gate driver 300 may sequentially apply the plurality of gate signals to the gate lines GL.

The data driver 400 receives the second control signal CONT2 and the output image data RGBD' from the timing controller 200. The data driver 400 generates a plurality of data voltages (e.g., analog data voltages) based on the second control signal CONT2 and the output image data RGBD' (e.g., digital image data). The data driver 400 may sequentially apply the plurality of data voltages to the data lines DL.

In an exemplary embodiment of the present inventive concept, the gate driver 300 and/or the data driver 400 may be disposed, e.g., directly mounted, on the display panel 100, or may be connected to the display panel 100 in a tape carrier package ("TCP") type. In an exemplary embodiment of the present inventive concept, the gate driver 300 and/or the data driver 400 may be integrated on the display panel 100.

The display panel 100 included in the display apparatus 10 according to an exemplary embodiment of the present inventive concept may operate based on an inversion driving scheme in which a polarity of each data voltage applied to a respective one pixel is reversed with respect to the common voltage every a predetermined period. The inversion driving scheme may include a line inversion driving scheme where pixels in the same line (e.g., the same gate line or the same data line) have the same polarity and a dot inversion driving scheme where each pixel is surrounded by pixels having the opposite polarity. The line inversion driving scheme and the dot inversion driving scheme will be described below with reference to FIGS. 4B, 5B, and 7B.

As will be described below with reference to FIGS. 2 and 6, the data driver 400 may include a digital-to-analog converter 430, a control signal output circuit 450, and an output buffer 440. When the display panel 100 operates based on the inversion driving scheme, the plurality of data voltages may include first data voltages and second data voltages. Each first data voltage may have a positive polarity, and each second data voltage may have a negative polarity. For example, the first data voltages may be data voltages with the positive polarity, and the second data voltages may be data voltages with the negative polarity. The digital-to-analog converter may generate at least one of the first data voltages and the second data voltages. The control signal output circuit 450 may output at least one of a first output control signal and a second output control signal that have different phases from each other. The output buffer may output the first data voltages and the second data voltages based on the first output control signal and the second output control signal. For example, the output buffer may output the first data voltages based on the first output control signal and may output the second data voltages based on the second output control signal.

In the display apparatus 10 according to an exemplary embodiment of the present inventive concept, the data driver 400 may control an output timing of the data voltages with the positive/negative polarities, and/or the gate driver 300 may control an output timing of the gate signals, and thus the display apparatus 10 may control a period in which the data voltages with the positive/negative polarities are applied to the pixels. Accordingly, an effective charging period (e.g., an effective period to charge the pixels based on the data voltages with the positive/negative polarities) may be compensated, and thus, display defects on the display apparatus 10 may be prevented.

Figure 2:
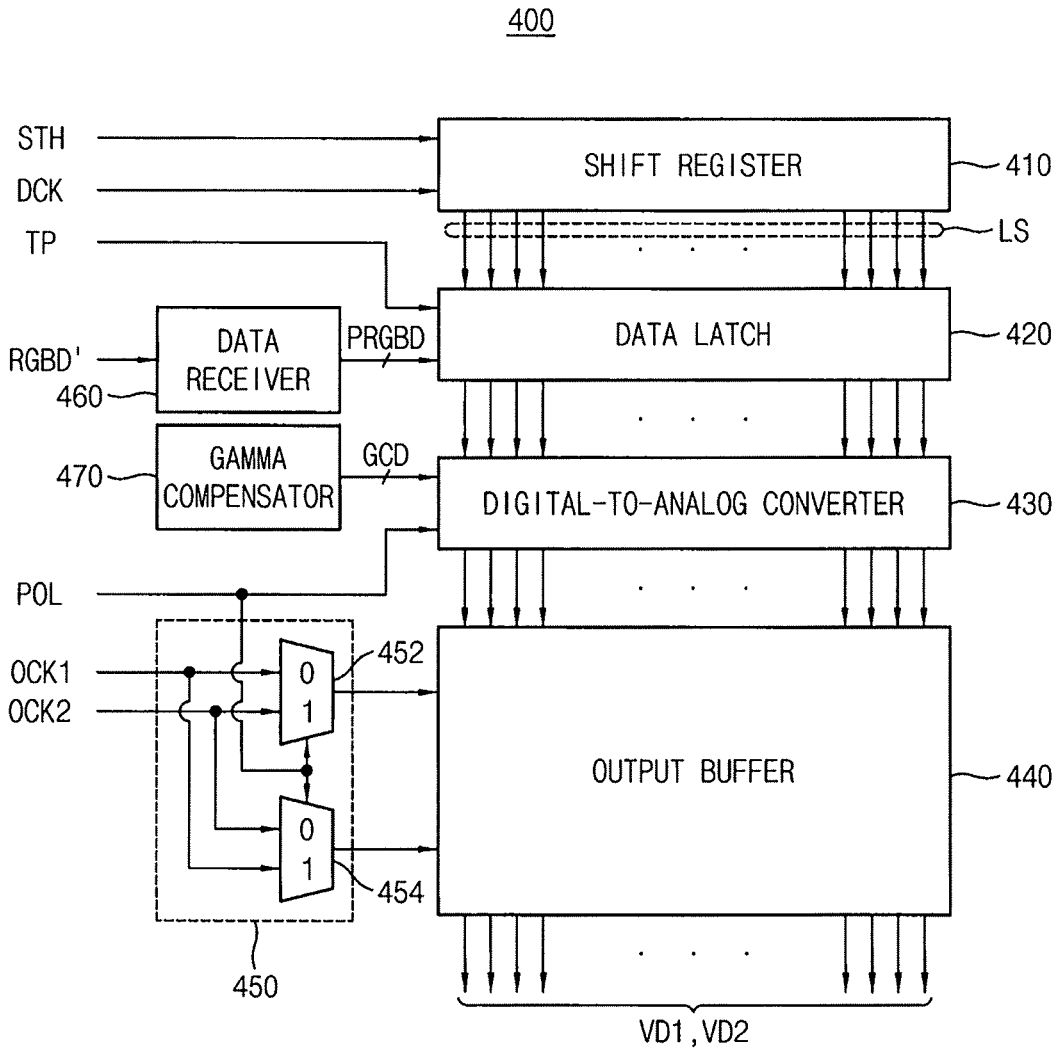
FIG. 2 is a block diagram illustrating a data driver according to an exemplary embodiment of the present inventive concept.

FIG. 2 is a block diagram illustrating a data driver according to an exemplary embodiment of the present inventive concept.

A data driver 400 of FIG. 2 may be included in the display apparatus 10 of FIG. 1. For example, the data driver 400 of FIG. 2 may drive the display panel 100 that operates based on the dot inversion driving scheme. In the dot inversion driving scheme, the data driver 400 may substantially simultaneously output the data voltages with the positive polarity and the data voltages with the negative polarity during one horizontal period.

Referring to FIG. 2, the data driver 400 includes a shift register 410, a data latch 420, a digital-to-analog converter 430, an output buffer 440, and a control signal output circuit 450. The data driver 400 may further include a data receiver 460 and a gamma compensator 470.

The shift register 410 generates latch control signals LS based on a horizontal start signal STH and a data clock signal DCK. The horizontal start signal STH and the data clock signal DCK may be included in the second control signal CONT2 that is provided from the timing controller 200 in FIG. 1.

The data receiver 460 may receive the output image data RGBD' and may convert the output image data RGBD' into parallel image data PRGBD. The output image data RGBD' may be serial image data that are provided from the timing controller 200 in FIG. 1.

The data latch 420 stores the parallel image data PRGBD based on the latch control signals LS. The parallel image data PRGBD may be sequentially stored in the data latch 420 based on the latch control signals LS. The data latch 420 outputs the parallel image data PRGBD based on a data load signal TP. The data load signal TP may be included in the second control signal CONT2 that is provided from the timing controller 200 in FIG. 1. The parallel image data PRGBD may be substantially simultaneously output from the data latch 420 based on the data load signal TP.

The digital-to-analog converter 430 generates first data voltages VD1 and second data voltages VD2 based on the parallel image data PRGBD and a polarity control signal POL. Each first data voltage has a positive polarity, and each second data voltage has a negative polarity. The first data voltages VD1 (e.g., data voltages with the positive polarity) may have levels higher than that of the common voltage. The second data voltages VD2 (e.g., data voltages with the negative polarity) may have levels lower than that of the common voltage. The polarity control signal POL may be included in the second control signal CONT2 that is provided from the timing controller 200 in FIG. 1.

The control signal output circuit 450 outputs a first output control signal OCK1 and a second output control signal OCK2 based on the polarity control signal POL. A phase of the second output control signal OCK2 is different from a phase of the first output control signal OCK1. A phase difference between the first output control signal OCK1 and the second output control signal OCK2 may correspond to a difference between a first effective charging period and a second effective charging period. The first effective charging period may represent an effective period to charge the pixels based on the data voltages having the positive polarity, and the second effective charging period may represent an effective period to charge the pixels based on the data voltages with the negative polarity. For example, the first output control signal OCK1 and the second output control signal OCK2 may be generated based on a frame configuration in an USI-T interface, which is one of protocols between the data driver 400 and the timing controller 200 in FIG. 1.

In an exemplary embodiment of the present inventive concept, the first output control signal OCK1 and the second output control signal OCK2 may be included in the second control signal CONT2 that is provided from the timing controller 200 in FIG. 1. In this case, one of the first output control signal OCK1 and the second output control signal OCK2 may be substantially the same as the data clock signal DCK. In an exemplary embodiment of the present inventive concept, the first output control signal OCK1 and the second output control signal OCK2 may be generated in the data driver 400. In this case, the data driver 400 may further include an output control signal generator for generating the first output control signal OCK1 and the second output control signal OCK2.

The control signal output circuit 450 may include a first selector 452 and a second selector 454. The first selector 452 may select one of the first output control signal OCK1 and the second output control signal OCK2 based on the polarity control signal POL. The second selector 454 may select another one of the first output control signal OCK1 and the second output control signal OCK2 based on the polarity control signal POL. For example, when the polarity control signal POL has a first logic level (e.g., '0'), the first selector 452 may select the first output control signal OCK1, and the second selector 454 may select the second output control signal OCK2. When the polarity control signal POL has a second logic level (e.g., '1'), the first selector 452 may select the second output control signal OCK2, and the second selector 454 may select the first output control signal OCK1.

The output buffer 440 outputs the first data voltages VD1 based on the first output control signal OCK1 and outputs the second data voltages VD2 based on the second output control signal OCK2. For example, the output buffer 440 may output the first data voltages VD1 in synchronization with the first output control signal OCK1 and may output the second data voltages VD2 in synchronization with the second output control signal OCK2.

The output buffer 440 may be connected to the plurality of data lines DL in FIG. 1. The first data voltages VD1 and the second data voltages VD2 output from the output buffer 440 may be applied to the display panel 100 in FIG. 1. For example, during a first horizontal period, the output buffer 440 may output one of the first and second data voltages VD1 and VD2 through first data lines among the plurality of data lines DL in FIG. 1 and may output another one of the first and second data voltages VD1 and VD2 through second data lines among the plurality of data lines DL in FIG. 1.

The gamma compensator 470 may generate gamma compensation data GCD. In this case, the digital-to-analog converter 430 may compensate the parallel image data PRGBD based on the gamma compensation data GCD to generate the first data voltages VD1 and the second data voltages VD2. For example, the gamma compensation data GCD may be digital data, and the data driver 400 may perform a digital gamma compensation on the output image data RGBD' (e.g., the parallel image data PRGBD) based on the gamma compensation data GCD.

Figure 3:
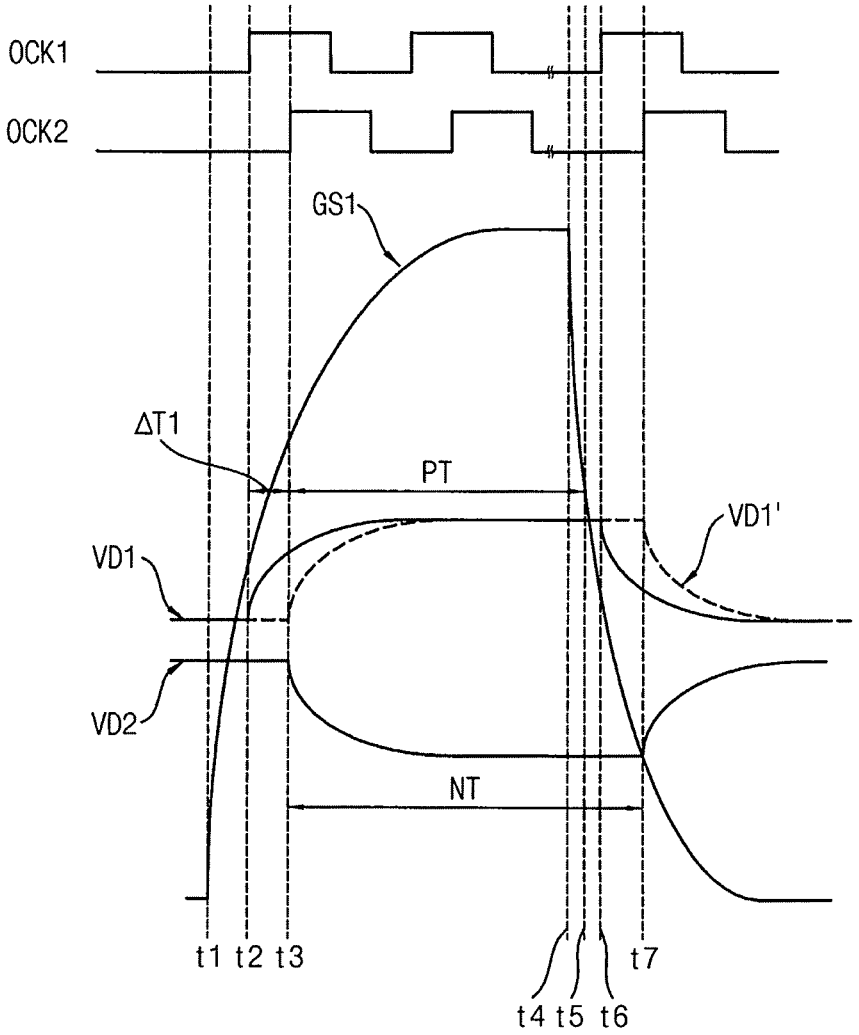
FIG. 3 is a diagram for describing an operation of the data driver of FIG. 2 according to an exemplary embodiment of the present inventive concept.

FIG. 3 is a diagram for describing an operation of the data driver of FIG. 2 according to an exemplary embodiment of the present inventive concept. FIG. 3 illustrates that the data driver 400 outputs the first and second data voltages VD1 and VD2 during the first horizontal period.

Referring to FIGS. 1, 2, and 3, at a time t1, a first gate signal GS1 is activated. The gate driver 300 may activate the first gate signal GS1. When the first gate signal GS1 is activated, pixels connected to a first gate line among the plurality of gate lines GL are enabled. The first gate signal GS1 is applied to the first gate line.

At a time t2, the first output control signal OCK1 is activated. The output buffer 440 outputs the first data voltages VD1 in synchronization with a rising edge of the first output control signal OCK1. For example, the first data voltages VD1 may be applied to the first data lines among the plurality of data lines DL and thus, may be applied to first pixels connected to the first data lines among the pixels connected to the first gate line. After the time t2, the first output control signal OCK1 is repeatedly toggled.

At a time t3, the second output control signal OCK2 is activated. The output buffer 440 outputs the second data voltages VD2 in synchronization with a rising edge of the second output control signal OCK2. For example, the second data voltages VD2 may be applied to the second data lines among the plurality of data lines DL and thus, may be applied to second pixels connected to the second data lines among the pixels connected to the first gate line. After the time t3, the second output control signal OCK2 is repeatedly toggled.

At a time t4, the first gate signal GS1 is deactivated. The gate driver 300 may deactivate the first gate signal GS1. The first gate signal GS1 may exponentially decrease due to an RC delay. The first gate signal GS1 crosses the first data voltages VD1 at a time t5.

At a time t6, the data driver 400 stops outputting the first data voltages VD1 in synchronization with a rising edge of the first output control signal OCK1. The first data voltages VD1 may exponentially decrease due to the RC delay. At a time t7, the data driver 400 stops outputting the second data voltages VD2 in synchronization with a rising edge of the second output control signal OCK2. The second data voltages VD2 may logarithmically increase due to the RC delay. The first gate signal GS1 crosses the second data voltages VD2 at a time t7.

As described above, the phase of the second output control signal OCK2 is different from the phase of the first output control signal OCK1. For example, as illustrated in FIG. 3, the phase of the first output control signal OCK1 may lead the phase of the second output control signal by a first period ΔT1 corresponding to a time difference between the time t3 and the time t2. Phases of the first data voltages VD1 may lead phases of the second data voltages VD2 by the first period ΔT1. For example, the data driver 400 may output the first data voltages VD1, and then may output the second data voltages VD2 after the first period ΔT1 elapses from a time at which the data driver 400 starts to output the first data voltages VD1.

If first data voltages VD1' and the second data voltages VD2 are substantially simultaneously applied to the first and second data lines, a first effective charging period PT by the first data voltages VD1' with the positive polarity is shorter than a second effective charging period NT by the second data voltages VD2 with the negative polarity. For example, if the first and second data voltages VD1' and VD2 are substantially simultaneously output from the data driver 400, the first effective charging period PT may be a period from a time at which the first data voltages VD1' are applied to the first data lines (e.g., time t3) to a time at which the first gate signal GS1 crosses the first data voltages VD1' (e.g., time t5), and the second effective charging period NT may be a period from a time at which the second data voltages VD2 are applied to the second data lines (e.g., time t3) to a time at which the first gate signal GS1 crosses the second data voltages VD2 (e.g., time t7).

The data driver 400 according to an exemplary embodiment of the present inventive concept may sequentially output the first and second data voltages VD1 and VD2, respectively, based on the first and second output control signals OCK1 and OCK2 that have different phases from each other. For example, the first data voltages VD1 may be applied to the first data lines, and then the second data voltages VD2 may be applied to the second data lines after the first period ΔT1 elapses from a time at which the data driver 400 starts to apply the first data voltages VD1 to the first data lines. In this case, a first effective period charged by the first data voltages VD1 with the positive polarity may be a period from a time at which the first data voltages VD1 are applied to the first data lines (e.g., time t2) to a time at which the first gate signal GS1 crosses the first data voltages VD1 (e.g., time t5). For example, an effective period to charge the first pixels based on the first data voltages VD1 may increase by the first period ΔT1. Accordingly, the data driver 400 may compensate the effective charging period (e.g., the effective period charged by the first data voltages VD1 with the positive polarity), and thus, display defects on the display apparatus 10 including the data driver 400 may be prevented.

During a second horizontal period subsequent to the first horizontal period, the data driver 400 may output third data voltages with the negative polarity and fourth data voltages with the positive polarity. For example, during the second horizontal period, a second gate signal GS2 that is applied to a second gate line adjacent to the first gate line is activated, the third data voltages may be applied to the first data lines based on the second output control signal OCK2, and the fourth data voltages may be applied to the second data lines based on the first output control signal OCK1. The data driver 400 may compensate an effective charging period (e.g., an effective period charged by the fourth data voltages with the positive polarity) based on the first output control signal OCK1.

Figure 4A:
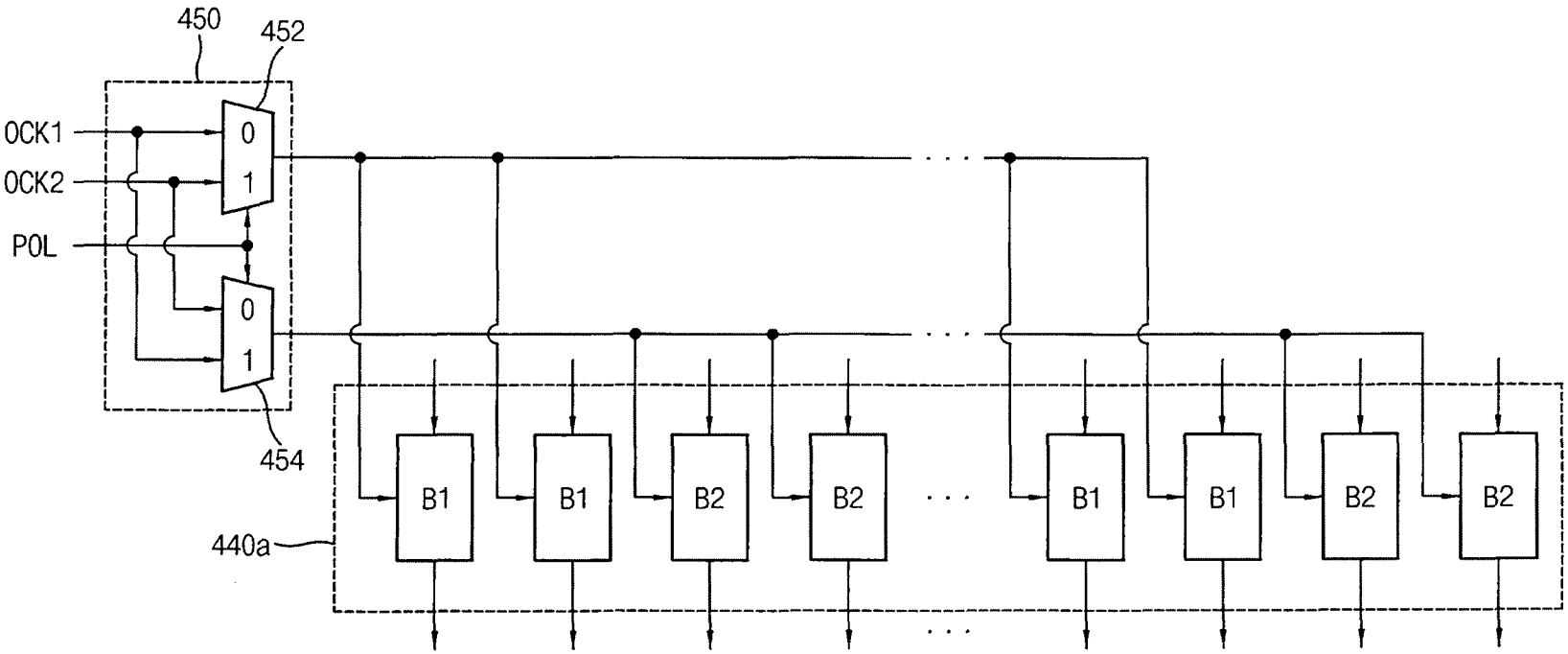
FIG. 4A is a block diagram illustrating an output buffer in the data driver of FIG. 2 according to an exemplary embodiment of the present inventive concept.

FIG. 4A is a block diagram illustrating an output buffer included in the data driver of FIG. 2 according to an exemplary embodiment of the present inventive concept. FIG. 4B is a diagram illustrating a display panel that operates based on a data driver including the output buffer of FIG. 4A according to an exemplary embodiment of the present inventive concept.

Referring to FIGS. 4A and 4B, an output buffer 440*a* may include a plurality of first buffers B1 and a plurality of second buffers B2.

Two first buffers B1 and two second buffers B2 may be alternately arranged in the output buffer 440*a*. For example, two first buffers B1 may be consecutively disposed, two second buffers B2 may be consecutively disposed adjacent to two first buffers B1, and another two first buffers B1 may be consecutively disposed adjacent to the two second buffers B2.

The plurality of first buffers B1 and the plurality of second buffers B2 may receive one of the output signals from the first and second selectors 452 and 454 included in the control signal output circuit 450. For example, the plurality of first buffers B1 may receive the output signal from the first selector 452 and the plurality of second buffers B2 may receive the output signal from the second selector 454. The plurality of first buffers B1 may be connected to the first data lines and the plurality of second buffers B2 may be connected to the second data lines. For example, the first selector 452 may be connected to the first data lines through the plurality of first buffers B1, and the second selector 454 may be connected to the second data lines through the plurality of second buffers B2.

The plurality of first buffers B1 may output one of the data voltages with the positive polarity and the data voltages with the negative polarity through the first data lines based on the output signal from the first selector 452. The plurality of second buffers B2 may output another one of the data voltages with the positive polarity and the data voltages with the negative polarity through the second data lines based on the output signal from the second selector 454.

In this case, as illustrated in FIG. 4B, the display panel may have a polarity pattern of a dot inversion where polarities of the pixels are inverted for every two pixels in a pixel row. For example, in the dot inversion, two consecutive pixels have the same polarity in the pixel row, and the two consecutive pixels are surrounded by pixels having the opposite polarity. For example, in a first frame, each of first and third pixel rows PR1 and PR3 may have a polarity pattern of "+, +, −, −, +, +, −, −" and each of second and fourth pixel rows PR2 and PR4 may have a polarity pattern of "−, −, +, +, −, −, +, +." which is inverted from the polarity pattern of the first and third pixel rows PR1 and PR3.

In a second frame subsequent to the first frame, each of the first and third pixel rows PR1 and PR3 may have a polarity pattern of "−, −, +, +, −, −, +, +," and each of the second and fourth pixel rows PR2 and PR4 may have a polarity pattern of "+, +, −, −, +, +, −, −" which is inverted from the polarity pattern of the first and third pixel rows PR1 and PR3.

Figure 5A:
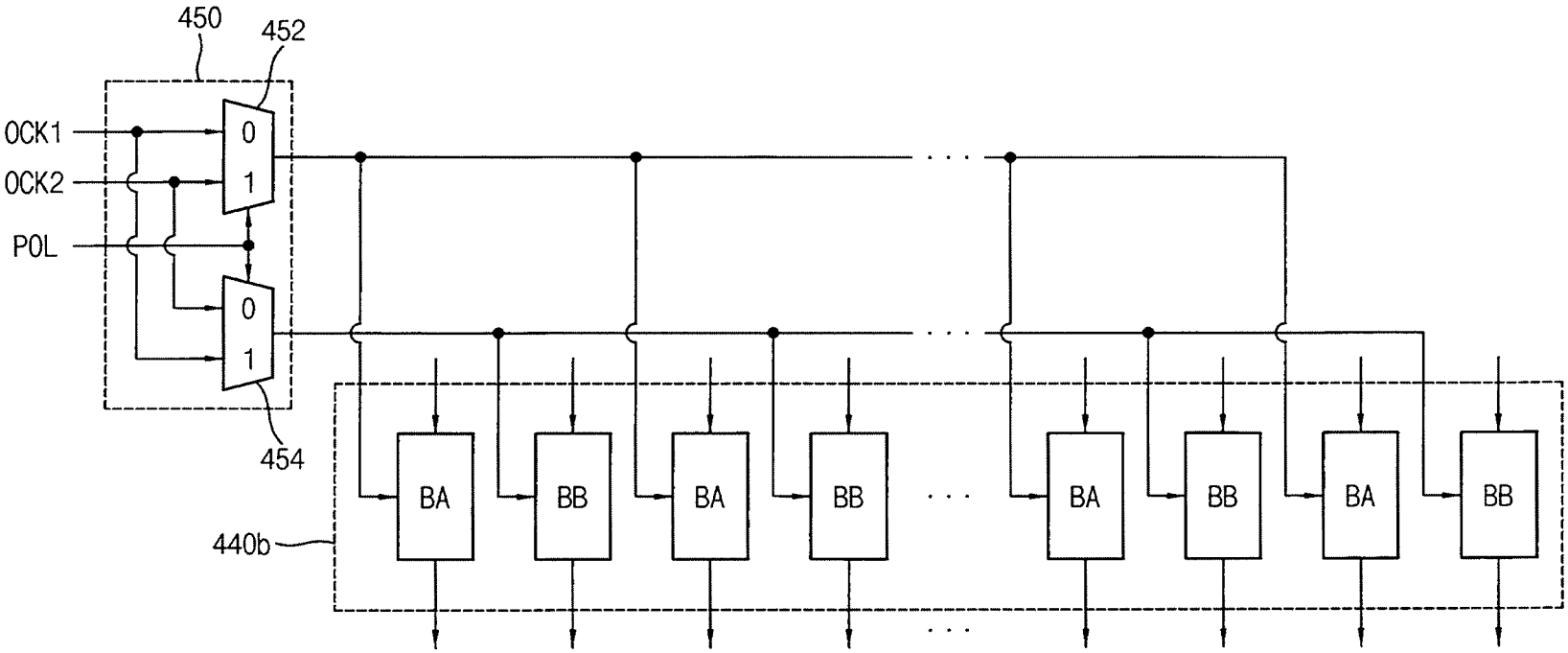
FIG. 5A is a block diagram illustrating an output buffer in the data driver of FIG. 2 according to an exemplary embodiment of the present inventive concept.
Figure 5B:
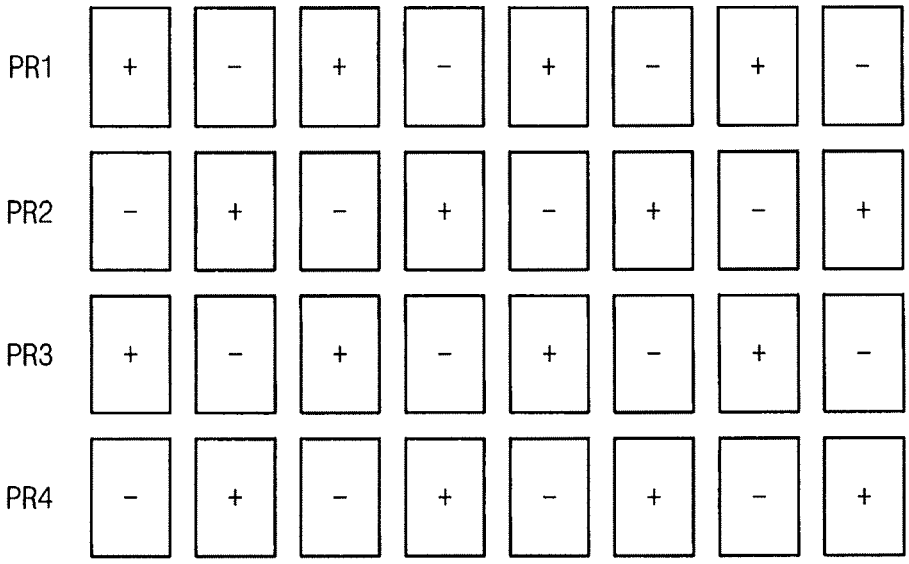
FIG. 5B is a diagram illustrating a display panel that operates based on a data driver including the output buffer of FIG. 5A according to an exemplary embodiment of the present inventive concept.

FIG. 5A is a block diagram illustrating an output buffer included in the data driver of FIG. 2 according to an exemplary embodiment of the present inventive concept. FIG. 5B is a diagram illustrating a display panel that operates based on a data driver including the output buffer of FIG. 5A according to an exemplary embodiment of the present inventive concept.

Referring to FIGS. 5A and 5B, an output buffer 440*b* may include a plurality of first buffers BA and a plurality of second buffers BB.

The first buffers BA and the second buffers BB may be alternately arranged one by one in the output buffer 440*b*. For example, one first buffer BA may be disposed, one second buffer BB may be disposed adjacent to the one first buffers BA and another one first buffer BA may be disposed adjacent to the one second buffer BB.

The plurality of first buffers BA and the plurality of second buffers BB may receive one of the output signals from the first and second selectors 452 and 454 included in the control signal output circuit 450. For example, the plurality of first buffers BA may receive the output signal from the first selector 452 and the plurality of second buffers BB may receive the output signal from the second selector 454. The plurality of first buffers BA may be connected to the first data lines, and the plurality of second buffers BB may be connected to the second data lines. For example, the first selector 452 may be connected to the first data lines through the plurality of first buffers BA, and the second selector 454 may be connected to the second data lines through the plurality of second buffers BB.

The plurality of first buffers BA may output one of the data voltages with the positive polarity and the data voltages with the negative polarity through the first data lines based on the output signal from the first selector 452. The plurality of second buffers BB may output another one of the data voltages with the positive polarity and the data voltages with the negative polarity through the second data lines based on the output signal from the second selector 454.

In this case, as illustrated in FIG. 5B, the display panel may have a polarity pattern of a dot inversion where one pixel is surrounded by pixels having the opposite polarity. For example, in a first frame, each of first and third pixel rows PR1 and PR3 may have a polarity pattern of "+, −, +, −, +, −, +, −," and each of second and fourth pixel rows PR2 and PR4 may have a polarity pattern of "−, +, −, +, −, +, −, +." which is inverted from the polarity pattern of the first and third pixel rows PR1 and PR3.

In a second frame subsequent to the first frame, each of the first and third pixel rows PR1 and PR3 may have a polarity pattern of "−, +, −, +, −, +, −, +," and each of the second and fourth pixel rows PR2 and PR4 may have an inverted polarity pattern of "+, −, +, −, +, −, +, −." which is inverted from the polarity pattern of the first and third pixel rows PR1 and PR3.

Figure 6:
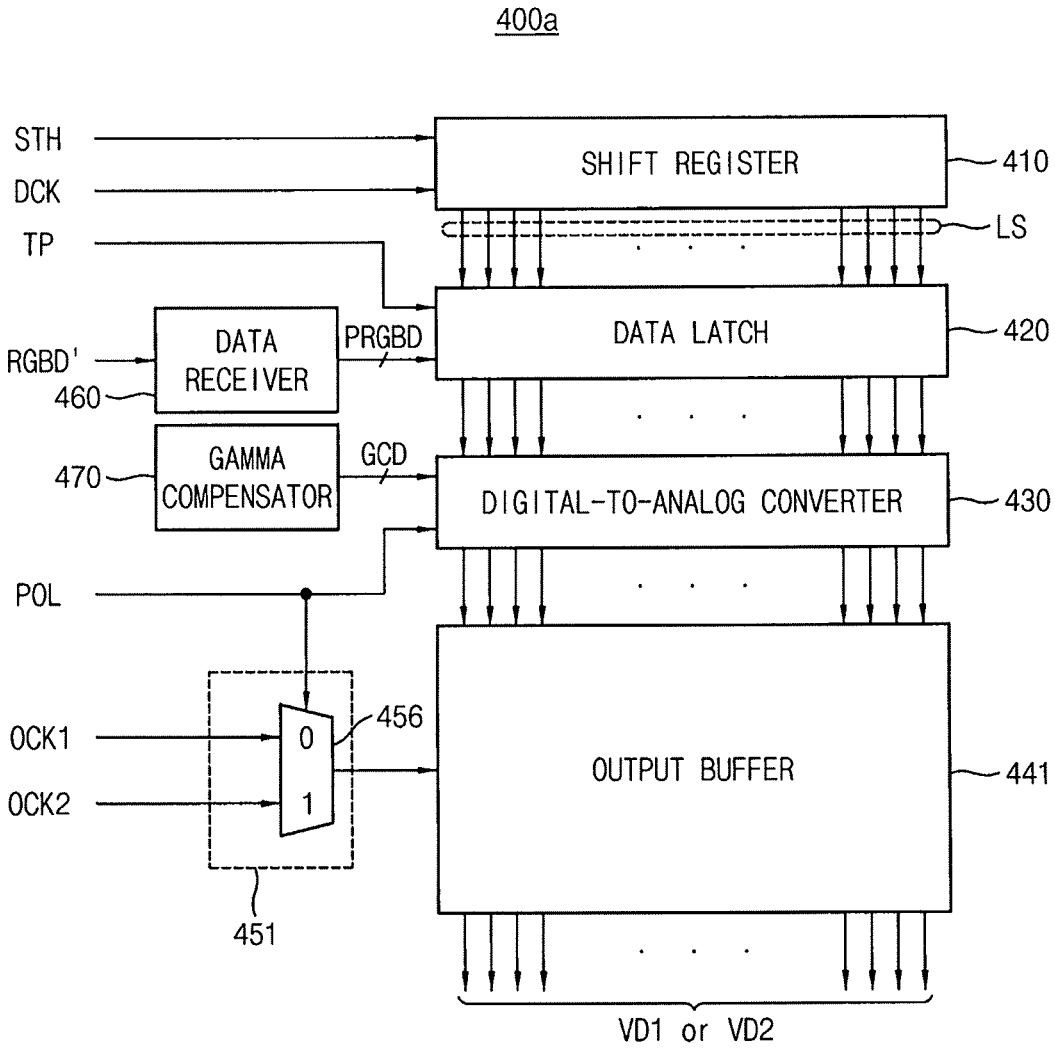
FIG. 6 is a block diagram illustrating a data driver according to an exemplary embodiment of the present inventive concept.

FIG. 6 is a block diagram illustrating a data driver according to an exemplary embodiment of the present inventive concept.

A data driver 400*a* of FIG. 6 may be included in the display apparatus 10 of FIG. 1. For example, the data driver 400*a* of FIG. 6 may drive the display panel 100 that operates based on the line inversion driving scheme. In the line inversion driving scheme, the data driver 400*a* may output one of the data voltages with the positive polarity and the data voltages with the negative polarity during one horizontal period.

Referring to FIG. 6, the data driver 400*a* includes a shift register 410, a data latch 420, a digital-to-analog converter 430, an output buffer 441, and a control signal output circuit 451. The data driver 400*a* may further include a data receiver 460 and a gamma compensator 470.

The shift register 410, the data latch 420, the digital-to-analog converter 430, the data receiver 460, and the gamma compensator 470 in FIG. 6 may be substantially the same as the shift register 410, the data latch 420, the digital-to-analog converter 430, the data receiver 460, and the gamma compensator 470 in FIG. 2, respectively.

The control signal output circuit 451 outputs one of a first output control signal OCK1 and a second output control signal OCK2 based on the polarity control signal POL. A phase of the second output control signal OCK2 is different from a phase of the first output control signal OCK1. The control signal output circuit 451 may include a first selector 456. The first selector 456 may select one of the first output control signal OCK1 and the second output control signal OCK2 based on the polarity control signal POL.

The output buffer 441 outputs one of the first data voltages VD1 and the second data voltages VD2 based on a selected one of the first output control signal OCK1 and the second output control signal OCK2. For example, the output buffer 441 may output the first data voltages VD1 in synchronization with the first output control signal OCK1 or may output the second data voltages VD2 in synchronization with the second output control signal OCK2.

The output buffer 441 may be connected the plurality of data lines DL in FIG. 1. One of the first data voltages VD1 and the second data voltages VD2, which are output from the output buffer 441, may be applied to the display panel 100 in FIG. 1. For example, during a first horizontal period, the output buffer 441 may output one of the first and second data voltages VD1 and VD2 through the plurality of data lines DL in FIG. 1.

An operation of the data driver 400*a* of FIG. 6 may be similar to the operation of the data driver 400 of FIG. 2 described above with reference to FIG. 3. For example, during the first horizontal period, the first gate signal GS1 is activated, and one of the first and second data voltages VD1 and VD2 are applied to the plurality of data lines DL in FIG. 1 based on one of the first and second output control signals OCK1 and OCK2. During the second horizontal period subsequent to the first horizontal period, the second gate signal GS2 is activated, and another one of the first and second data voltages VD1 and VD2 are applied to the plurality of data lines DL in FIG. 1 based on another one of the first and second output control signals OCK1 and OCK2. The phase of the first output control signal OCK1 may lead the phase of the second output control signal by the first period ΔT1, and the phases of the first data voltages VD1 may lead the phases of the second data voltages VD2 by the first period ΔT1. The data driver 400*a* may compensate the effective charging period (e.g., the effective period charged by the first data voltages VD1 with the positive polarity) based on the first output control signal OCK1.

Figure 7A:
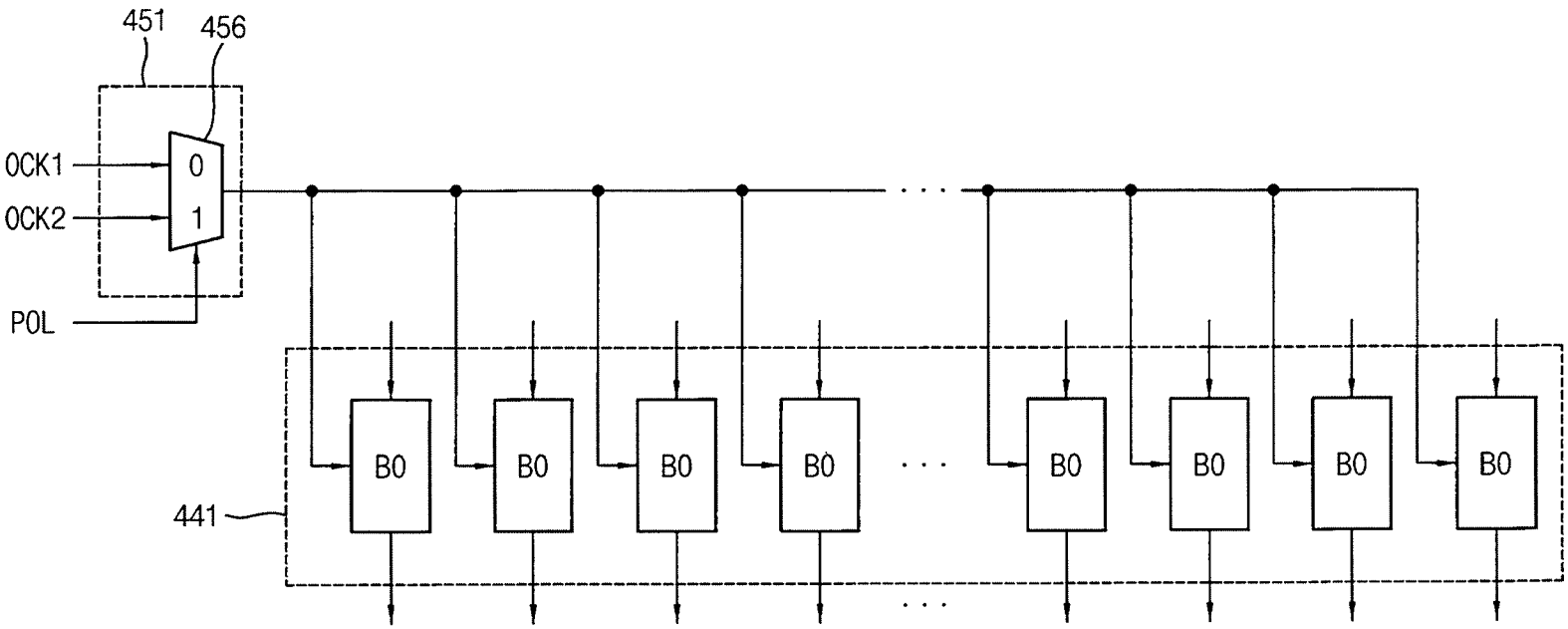
FIG. 7A is a block diagram illustrating an output buffer in the data driver of FIG. 6 according to an exemplary embodiment of the present inventive concept.
Figure 7B:
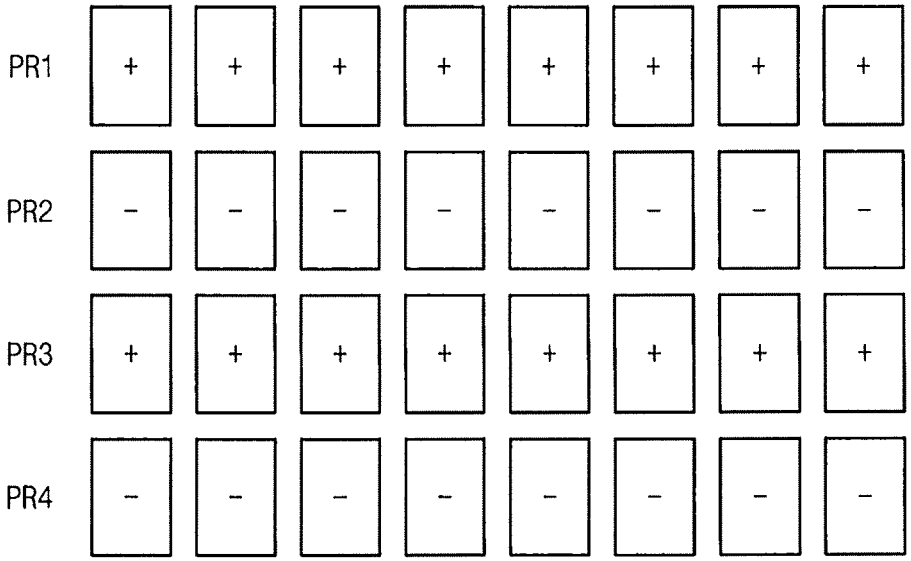
FIG. 7B is a diagram illustrating a display panel that operates based on a data driver including the output buffer of FIG. 7A according to an exemplary embodiment of the present inventive concept.

FIG. 7A is a block diagram illustrating an output buffer included in the data driver of FIG. 6 according to an exemplary embodiment of the present inventive concept. FIG. 7B is a diagram illustrating a display panel that operates based on a data driver including the output buffer of FIG. 7A according to an exemplary embodiment of the present inventive concept.

Referring to FIGS. 7A and 7B, an output buffer 441 may include a plurality of buffers B0.

The plurality of buffers B0 may receive the output signals from the first selector 456 included in the control signal output circuit 451. The plurality of buffers B0 may be connected to the plurality of data lines DL in FIG. 1. For example, the first selector 456 may be connected to the plurality of data lines DL in FIG. 1 through the plurality of buffers B0.

The plurality of buffers B0 may output one of the data voltages with the positive polarity and the data voltages with the negative polarity through the plurality of data lines DL in FIG. 1 based on the output signals from the first selector 456.

In this case, as illustrated in FIG. 7B, the display panel may have a polarity pattern of a line inversion where one pixel row is disposed between pixel rows having the opposite polarity. For example, in a first frame, each of first and third pixel rows PR1 and PR3 may have a polarity pattern of "+, +, +, +, +, +, +, +," and each of second and fourth pixel rows PR2 and PR4 may have a polarity pattern of "−, −, −, −, −, −, −, −." which is inverted from the polarity pattern of the first and third pixel rows PR1 and PR3.

In a second frame subsequent to the first frame, each of the first and third pixel rows PR1 and PR3 may have a polarity pattern of "−, −, −, −, −, −, −, −," and each of the second and fourth pixel rows PR2 and PR4 may have a polarity pattern of "+, +, +, +, +, +, +, +." which is inverted from the polarity pattern of the first and third pixel rows PR1 and PR3

Figure 8:
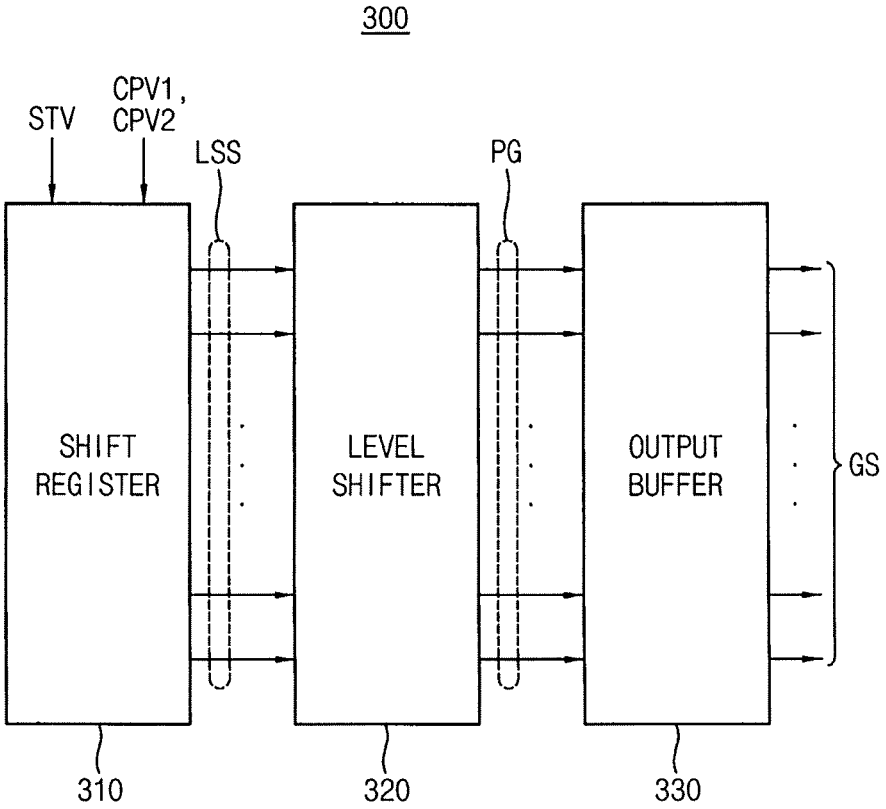
FIG. 8 is a block diagram illustrating a gate driver in the display apparatus of FIG. 1 according to an exemplary embodiment of the present inventive concept.

FIG. 8 is a block diagram illustrating a gate driver in the display apparatus of FIG. 1 according to an exemplary embodiment of the present inventive concept.

A gate driver 300 of FIG. 8 may be included in the display apparatus 10 of FIG. 1. For example, the gate driver 300 of FIG. 8 may drive the display panel 100 that operates based on the line inversion driving scheme. In the line inversion driving scheme, the data driver 400*a* of FIG. 6 may output one of the data voltages with the positive polarity and the data voltages with the negative polarity during one horizontal period.

Referring to FIG. 8, the gate driver 300 may include a shift register 310, a level shifter 320, and an output buffer 330.

The shift register 310 may generate level shifter control signals LSS based on a vertical start signal STV, a first gate clock signal CPV1, and a second gate clock signal CPV2. The vertical start signal STV, the first gate clock signal CPV1, and the second gate clock signal CPV2 may be included in the first control signal CONT1 that is provided from the timing controller 200 in FIG. 1.

The level shifter 320 may generate pre-gate signals PG based on the level shifter control signals LSS. The output buffer 330 may generate a plurality of gate signals GS based on the pre-gate signals PG.

Figure 9:
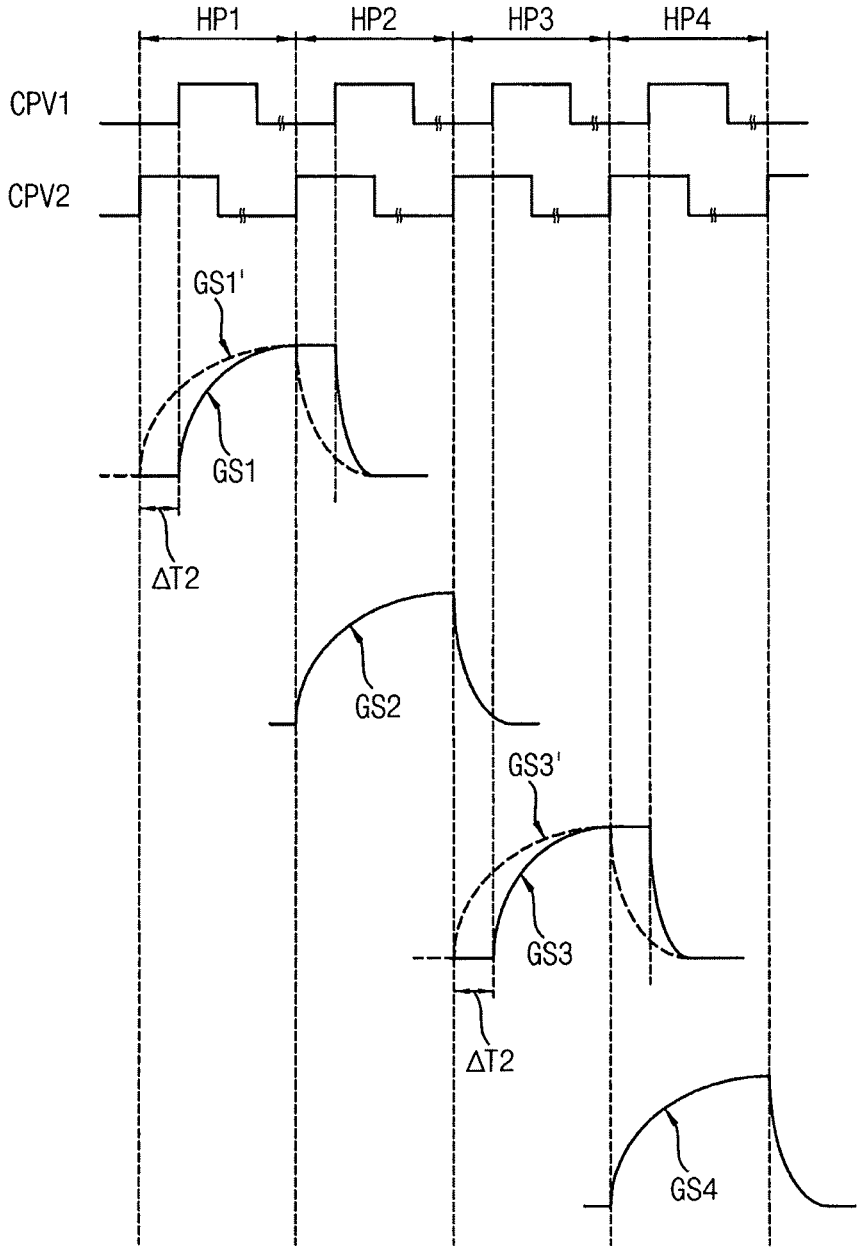
FIGS. 9 and 10 are diagrams for describing an operation of the gate driver of FIG. 8 according to an exemplary embodiment of the present inventive concept.
Figure 10:
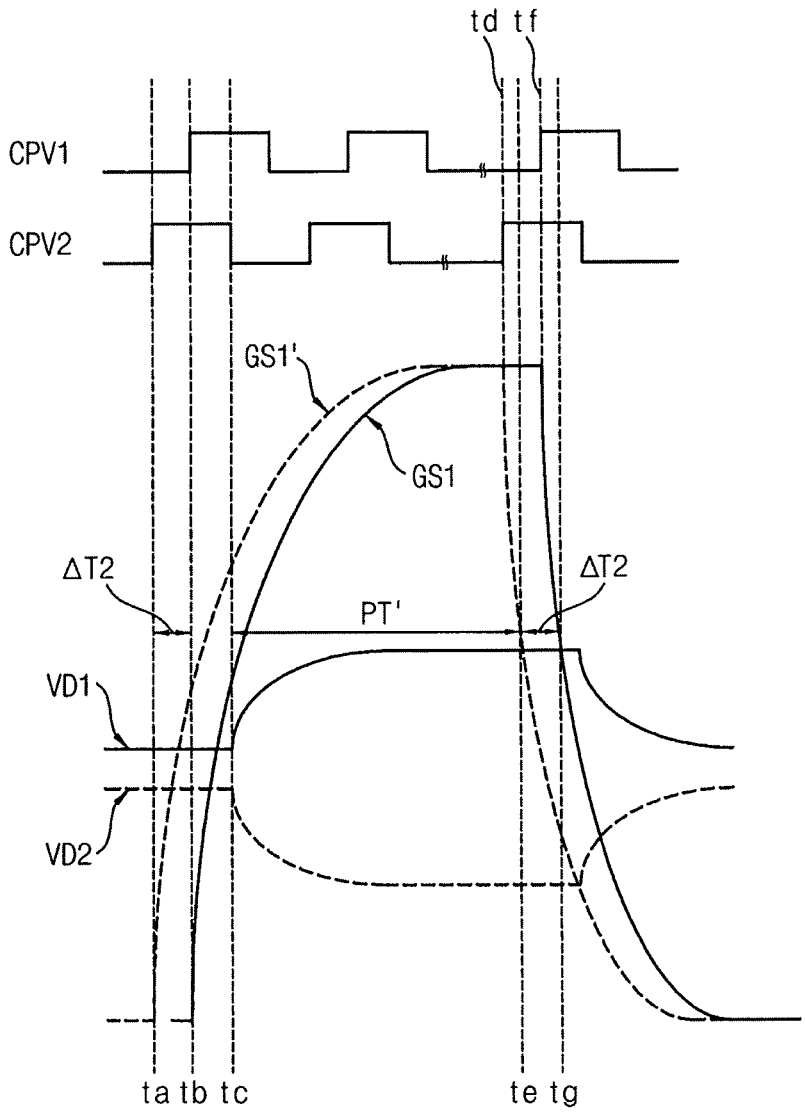

FIGS. 9 and 10 are diagrams for describing an operation of the gate driver of FIG. 8 according to an exemplary embodiment of the present inventive concept. FIG. 9 illustrates that the gate driver 300 sequentially generates the plurality of gate signals GS. FIG. 10 illustrates that the gate driver 300 generates a first gate signal GS1 among the plurality of gate signals GS.

Referring to FIGS. 1, 6, 7B, 8, and 9, during a first horizontal period HP1, the data driver 400*a* may output the first data voltages VD1 with the positive polarity through the plurality of data lines DL. The gate driver 300 may generate the first gate signal GS1 based on the first gate clock signal CPV1. The first data voltages VD1 may be applied to a plurality of first pixels in synchronization with the first gate signal GS1. The plurality of first pixels may be disposed in a first pixel row PR1 and may be connected to a first gate line to which the first gate signal GS1 is applied. Thus, the plurality of first pixels may be charged based on the first gate signal GS1 and the first data voltages VD1.

During a second horizontal period HP2 subsequent to the first horizontal period HP1, the data driver 400*a* may output the second data voltages VD2 with the negative polarity through the plurality of data lines DL. The gate driver 300 may generate a second gate signal GS2 based on the second gate clock signal CPV2. The second data voltages VD2 may be applied to a plurality of second pixels in synchronization with the second gate signal GS2. The plurality of second pixels may be disposed in a second pixel row PR2 adjacent to the first pixel row PR1 and may be connected to a second gate line to which the second gate signal GS2 is applied. Thus, the plurality of second pixels may be charged based on the second gate signal GS2 and the second data voltages VD2.

During a third horizontal period HP3 subsequent to the second horizontal period HP2, the data driver 400*a* may output third data voltages with the positive polarity through the plurality of data lines DL. The gate driver 300 may generate a third gate signal GS3 based on the first gate clock signal CPV1. The third data voltages may be applied to a plurality of third pixels in synchronization with the third gate signal GS3. The plurality of third pixels may be disposed in a third pixel row PR3 adjacent to the second pixel row PR2 and may be connected to a third gate line to which the third gate signal GS3 is applied. Thus, the plurality of third pixels may be charged based on the third gate signal GS3 and the third data voltages.

During a fourth horizontal period HP4 subsequent to the third horizontal period HP3, the data driver 400*a* may output fourth data voltages with the negative polarity through the plurality of data lines DL. The gate driver 300 may generate a fourth gate signal GS4 based on the second gate clock signal CPV2. The fourth data voltages may be applied to a plurality of fourth pixels in synchronization with the fourth gate signal GS4. The plurality of fourth pixels may be disposed in a fourth pixel row PR4 adjacent to the third pixel row PR1 and may be connected to a fourth gate line to which the fourth gate signal GS4 is applied. Thus, the plurality of fourth pixels may be charged based on the fourth gate signal GS4 and the fourth data voltages.

As illustrated in FIG. 9, a phase of the second gate clock signal CPV2 may be different from a phase of the first gate clock signal CPV1. For example, the phase of the first gate clock signal CPV1 may lag the phase of the second gate clock signal CPV2 by a second period ΔT2. Thus, the first gate signal GS1 may be activated after the second period ΔT2 elapses from a time at which the first horizontal period HP1 begins, and the third gate signal GS3 may be activated after the second period ΔT2 elapses from a time at which the third horizontal period HP3 begins. In addition, the second gate signal GS2 may be activated at a time at which the second horizontal period HP2 begins (e.g., without a delay), and the fourth gate signal GS4 may be activated at a time at which the fourth horizontal period HP4 begins (e.g., without a delay).

For example, the gate driver 300 according to an exemplary embodiment of the present inventive concept may activate the gate signals. In addition, the gate driver 300 may not activate the gate signals (e.g., GS1', GS2, GS3', and GS4 in FIG. 9) with the same delay, and may activate the gate signals (e.g., GS1, GS2, GS3, and GS4 of FIG. 9) with different delays based on the first and second gate clock signal CPV1 and CPV2 that have different phases from each other. For example, the gate signals GS1 and GS3 may be output after the second period ΔT2 elapses from times at which the first and third horizontal periods HP1 and HP3 begin, respectively. The gate signals GS2 and GS4 may be output at times at which the second and fourth horizontal periods HP2 and HP4 begin, respectively. The gate signals GS1 and GS3 may be provided to pixel rows to which the data voltages with the positive polarity are applied, and the gate signals GS2 and GS4 may be provided to pixel rows to which the data voltages with the negative polarity are applied.

Referring to FIGS. 1, 6, 8, and 10, at a time tb, the first gate clock signal CPV1 is activated. The gate driver 300 outputs the first gate signal GS1 in synchronization with a rising edge of the first gate clock signal CPV1. The first gate signal GS1 may be applied to the first gate line. After the time tb, the first gate clock signal CPV1 is repeatedly toggled.

At a time tc, the first data voltages VD1 with the positive polarity are applied to the plurality of data lines DL. The data driver 400*a* may output the first data voltages VD1.

At a time tf, the gate driver 300 stops outputting the first gate signal GS1 in synchronization with the rising edge of the first gate clock signal CPV1. The first gate signal GS1 may exponentially decrease due to an RC delay. The first gate signal GS1 crosses the first data voltages VD1 at a time tg.

If a first gate signal GS1' is output without a delay, a first effective charging period PT' by the first data voltages VD1 with the positive polarity may be relatively short. For example, if the second gate clock signal CPV2 is activated at a time ta, if the first gate signal GS1' is output in synchronization with a rising edge of the second gate clock signal CPV2 at the time ta, if the output of the first gate signal GS1' is stopped in synchronization with the rising edge of the second gate clock signal CPV2 at a time td, and if the first gate signal GS1' crosses the first data voltages VD1 at a time te, the first effective charging period PT' may be a period from a time at which the first data voltages VD1 are applied to the plurality of data lines DL (e.g., time tc) to a time at which the first gate signal GS1' crosses the first data voltages VD1 (e.g., time te).

The gate driver 300 according to an exemplary embodiment of the present inventive concept may output the first gate signal GS1 after the second period ΔT2 elapses from a time at which the first horizontal period HP1 begins, based on the first and second gate clock signal CPV1 and CPV2 that have different phases from each other. In this case, a first effective period charged by the first data voltages VD1 with the positive polarity may be a period from a time at which the first data voltages VD1 are applied to the plurality of data lines DL (e.g., time tc) to a time at which the first gate signal GS1 crosses the first data voltages VD1 (e.g., time tg). For example, an effective period to charge the first pixels based on the first data voltages VD1 may increase by the second period ΔT2. Accordingly, the gate driver 300 may compensate the effective charging period (e.g., the effective period charged by the first data voltages VD1 with the positive polarity), and display defects on the display apparatus 10 including the gate driver 300 may be prevented.

Although it is described in the exemplary embodiments where the effective period charged by the data voltages with the positive polarity is compensated by shifting timings of the data voltages and/or the gate signals, the present inventive concept is not limited thereto. For example, an effective period charged by the data voltages with the negative polarity may be compensated by shifting timing of the data voltages and/or the gate signals according to an exemplary embodiment.

The above described embodiments may be used in a data driver, a display apparatus, and/or a system including the display apparatus, such as a mobile phone, a smart phone, a personal digital assistance (PDA), a portable media player (PMP), a digital camera, a digital television, a set-top box, a music player, a portable game console, a navigation device, a personal computer (PC), a server computer, a workstation, a tablet computer, a laptop computer, a smart card, a printer, etc.

The foregoing is illustrative of exemplary embodiments of the present inventive concept and the present inventive concept should not be construed as being limited to the exemplary embodiments disclosed herein. Although a few exemplary embodiments have been described, it will be understood that various modifications in forms and detail may be possible without materially departing from the spirit and scope of the present inventive concept as defined in the appended claims.

What is claimed is:

1. A data driver comprising:

a shift register configured to generate latch control signals based on a horizontal start signal and a data clock signal;

a data latch configured to store parallel image data based on the latch control signals and to output the parallel image data based on a data load signal;

a digital-to-analog converter configured to generate first data voltages and second data voltages based on the parallel image data and a polarity control signal, wherein each of the first data voltages has a positive polarity and each of the second data voltages has a negative polarity;

a control signal output circuit configured to output a first output control signal and a second output control signal based on the polarity control signal, wherein a phase of the second output control signal is different from a phase of the first output control signal; and an output buffer configured to output the first data voltages based on the first output control signal and to output the second data voltages based on the second output control signal, wherein, during a single horizontal period, the phase of the first output control signal leads the phase of the second output control signal by a first period, and phases of the first data voltages lead phases of the second data voltages by the first period, and wherein a high level of the first output control signal partially overlaps a high level of the second output control signal.

2. The data driver of claim 1, wherein the output buffer outputs the first data voltages in synchronization with the first output control signal and outputs the second data voltages in synchronization with the second output control signal.

3. The data driver of claim 2, wherein a period to charge pixels based on the first data voltages increases by the first period.

4. The data driver of claim 1, wherein the control signal output circuit includes:

a first selector configured to select one of the first output control signal or the second output control signal based on the polarity control signal; and a second selector configured to select another one of the first output control signal or the second output control signal based on the polarity control signal.

5. The data driver of claim 4, wherein the output buffer is connected to a plurality of data lines, wherein the first selector is connected to first data lines among the plurality of data lines, and the second selector is connected to second data lines among the plurality of data lines.

6. The data driver of claim 5, wherein, during a first horizontal period, the output buffer outputs one of the first data voltages or the second data voltages through the first data lines based on one of the first output control signal or the second output control signal, and outputs another one of the first data voltages or the second data voltages through the second data lines based on another one of the first output control signal or the second output control signal.

7. The data driver of claim 1, further comprising:

a data receiver configured to receive serial image data and to convert the serial image data into the parallel image data.

8. The data driver of claim 1, further comprising:

a gamma compensator configured to generate gamma compensation data, wherein the digital-to-analog converter compensates the parallel image data based on the gamma compensation data to generate the first data voltages or the second data voltages.

9. A display apparatus comprising:

a display panel connected to a plurality of gate lines and a plurality of data lines;

a gate driver configured to generate a plurality of gate signals and to apply the plurality of gate signals to the plurality of gate lines;

a data driver configured to generate a plurality of data voltages based on output image data and to apply the plurality of data voltages to the plurality of data lines; and a timing controller configured to control operations of the gate driver and the data driver and to generate the output image data based on input image data, and wherein the data driver comprises:

a shift register configured to generate latch control signals based on a horizontal start signal and a data clock signal;

a data latch configured to store parallel image data corresponding to the output image data based on the latch control signals and to output the parallel image data based on a data load signal;

a digital-to-analog converter configured to generate at least one of first data voltages or second data voltages based on the parallel image data and a polarity control signal, wherein each of the first data voltages has a positive polarity and each of the second data voltages has a negative polarity;

a control signal output circuit configured to output at least one of a first output control signal or a second output control signal based on the polarity control signal, wherein a phase of the second output control signal is different from a phase of the first output control signal; and an output buffer configured to output the first data voltages based on the first output control signal and to output the second data voltages based on the second output control signal, wherein, during a single horizontal period, the phase of the first output control signal leads the phase of the second output control signal by a first period, and phases of the first data voltages lead phases of the second data voltages by the first period, wherein a high level of the first output control signal partially overlaps a high level of the second output control signal.

10. The display apparatus of claim 9, wherein the output buffer outputs the first data voltages in synchronization with the first output control signal and outputs the second data voltages in synchronization with the second output control signal.

11. The display apparatus of claim 10, wherein a period to charge pixels in the display panel based on the first data voltages increases by the first period.

12. The display apparatus of claim 9, wherein, during a first horizontal period, the output buffer outputs one of the first data voltages or the second data voltages through first data lines among the plurality of data lines based on one of the first output control signal or the second output control signal, and outputs another one of the first data voltages or the second data voltages through second data lines among the plurality of data lines based on another one of the first output control signal or the second output control signal.

13. The display apparatus of claim 12, wherein the control signal output circuit includes:

a first selector connected to the first data lines, the first selector configured to select one of the first output control signal or the second output control signal based on the polarity control signal; and a second selector connected to the second data lines, the second selector configured to select another one of the first output control signal or the second output control signal based on the polarity control signal.

14. The display apparatus of claim 9, wherein the output buffer outputs one of the first data voltages or the second data voltages through the plurality of data lines based on one of the first output control signal or the second output control signal during a first horizontal period, and outputs another one of the first data voltages or the second data voltages through the plurality of data lines based on another one of the first output control signal or the second output control signal during a second horizontal period subsequent to the first horizontal period.

15. The display apparatus of claim 14, wherein the control signal output circuit includes:

a first selector connected to the plurality of data lines, the first selector configured to select one of the first output control signal or the second output control signal based on the polarity control signal.

16. The display apparatus of claim 14, wherein when the output buffer outputs the first data voltages during the first horizontal period, the gate driver generates a first gate signal among the plurality of gate signals based on a first gate clock signal, and a plurality of first pixels connected to a first gate line among the plurality of gate lines are charged based on the first gate signal and the first data voltages, and when the output buffer outputs the second data voltages during the second horizontal period, the gate driver generates a second gate signal among the plurality of gate signals based on a second gate clock signal, and a plurality of second pixels connected to a second gate line among the plurality of gate lines are charged based on the second gate signal and the second data voltages, wherein a phase of the second gate clock signal is different from a phase of the first gate clock signal.

17. The display apparatus of claim 16, wherein the first data voltages are applied to the plurality of first pixels in synchronization with the first gate signal, and the second data voltages are applied to the plurality of second pixels in synchronization with the second gate signal, wherein the phase of the first gate clock signal lags the phase of the second gate clock signal by a first period, and the first gate signal is activated after the first period elapses from a time at which the first horizontal period begins.

18. A driver circuit comprising:

a gate driver configured to generate a plurality of gate signals and to apply the plurality of gate signals to a plurality of gate lines;

a data driver configured to generate a plurality of data voltages based on output image data and to apply the plurality of data voltages to a plurality of data lines; and a timing controller configured to control operations of the gate driver and the data driver and to generate the output image data based on input image data, wherein, during a single horizontal period, a phase of a first output control signal leads a phase of a second output control signal by a first period, and phases of first data voltages lead phases of second data voltages by the first period, wherein a high level of the first output control signal partially overlaps a high level of the second output control signal, and wherein the data driver includes:

a shift register configured to generate latch control signals based on a horizontal start signal and a data clock signal;

a data latch configured to store parallel image data based on the latch control signals and to output the parallel image data based on a data load signal;

a digital-to-analog converter configured to generate one of the first data voltages or the second data voltages based on the parallel image data and a polarity control signal, wherein each of the first data voltages has a positive polarity, each of the second data voltages has a negative polarity;

a control signal output circuit configured to output one of the first output control signal or the second output control signal based on the polarity control signal, wherein the phase of the second output control signal is different from the phase of the first output control signal; and an output buffer configured to output one of the first data voltages or the second data voltages based on one of the first output control signal or the second output control signal, and wherein the gate driver includes:

a gate shift register responsive to first and second gate clock signals corresponding to first and second polarities, respectively;

a gate level shifter connected to the gate shift register; and a gate output buffer connected to the gate level shifter, the gate output buffer configured to provide during a first horizontal period a first gate signal based on the first gate clock signal for applying the first data voltages of the positive polarity to a plurality of first pixels in synchronization with the first gate signal, where the plurality of first pixels are disposed in a first pixel row and connected to a first gate line to which the first gate signal is applied, and the gate output buffer configured to provide during a second horizontal period subsequent to the first horizontal period and apply the second data voltages with the negative polarity through the plurality of data lines by providing a second gate signal based on the second gate clock signal.

19. The driver circuit of claim 18, wherein the output buffer outputs the first data voltages in synchronization with the first output control signal or outputs the second data voltages in synchronization with the second output control signal.

20. The driver circuit of claim 18, wherein the output buffer is connected to a plurality of data lines, wherein the output buffer outputs one of the first data voltages or the second data voltages through the plurality of data lines based on one of the first output control signal or the second output control signal during a first horizontal period.

21. The data driver of claim 1 wherein the output buffer is configured to output the first data voltages based on the first output control signal and to output the second data voltages based on the second output control signal substantially simultaneously within a same horizontal data row.

22. The display apparatus of claim 9 wherein the output buffer is configured to output the first data voltages based on the first output control signal and to output the second data voltages based on the second output control signal substantially simultaneously within a same horizontal data row.

23. The driver circuit of claim 18 wherein the output buffer is configured to output one of the first data voltages or the second data voltages based on one of the first output control signal or the second output control signal, respectively, within one horizontal data row, and to output the other one of the first data voltages or the second data voltages based on the other one of the first output control signal or the second output control signal, respectively, within another horizontal data row.

* * * * *